United States Patent [19]

Clark et al.

[11] Patent Number: 4,758,133

[45] Date of Patent: Jul. 19, 1988

[54] PUMPING SYSTEM

[75] Inventors: Burns W. Clark, Mansfield; Paul F. Brown, Mt. Vernon, both of Ohio

[73] Assignee: The Gorman-Rupp Company, Mansfield, Ohio

[21] Appl. No.: 864,826

[22] Filed: May 19, 1986

[51] Int. Cl.[4] ..... F04B 17/00; F04B 35/00

[52] U.S. Cl. ..... 417/360

[58] Field of Search ..... 417/360, 40; 137/363, 137/388, 371, 358, 585, 590, 591, 592, 587; 52/66, 72, 20, 169.6

[56] References Cited

U.S. PATENT DOCUMENTS

| | | | |
|---|---|---|---|
| 494,797 | 4/1893 | Rowland | 137/371 |
| 1,851,084 | 3/1932 | Brown et al. | 137/388 |
| 1,964,034 | 6/1934 | Cook | 417/36 |
| 2,229,908 | 1/1941 | Wenneborg | 52/66 |
| 2,393,078 | 1/1946 | Wager | 137/388 |
| 2,408,166 | 9/1946 | Hawkins | 137/388 |
| 2,783,523 | 3/1957 | Halley | 137/388 |
| 2,792,794 | 5/1957 | Miller | 52/20 |
| 3,060,519 | 10/1962 | Francis | 52/66 |
| 3,342,136 | 9/1967 | Domecki | 417/40 |
| 3,461,803 | 10/1967 | Stothoff, III et al. | 417/36 |
| 3,513,605 | 5/1970 | Smith | 52/20 |
| 3,558,012 | 1/1971 | Weis | 417/360 |
| 3,675,967 | 7/1972 | Ahrens | 52/66 |
| 3,993,094 | 11/1976 | Spooner | 137/590 |
| 4,097,201 | 6/1978 | Nussbaum | 417/360 |
| 4,242,847 | 1/1981 | Rezin | 52/169.6 |
| 4,348,158 | 9/1982 | Wood | 417/40 |

*Primary Examiner*—William L. Freeh
*Assistant Examiner*—Donald E. Stout
*Attorney, Agent, or Firm*—Watts, Hoffmann, Fisher & Heinke Co.

[57] ABSTRACT

A partially buried pumping or lift station including a below-ground wet well covered by a well cap and a partially buried pumping unit having an above-ground, removable cover by which access to above-ground pumps is provided. The enclosure sits atop the wet well cap and includes a wall section extending substantially vertically that is sealingly engageable by the removable cover. The cover is raiseable by a jack mechanism that includes a hub assembly attached to the cover which allows the cover to be rotated about a vertical axis. The axis is located near a perimeter region of the wall section. The eccentric mounting of the cover allows the cover to be rotated to a retracted position at which it substantially completely exposes the interior of the enclosure. In an alternate embodiment, the cover is mounted to a trackway which supports the cover for rectilinear transverse movement. Vents provide ventilation air into the enclosure and are configured to restrict the inflow of flood waters into the enclosure during flood conditions to an amount that can be pumped from the station by the pumps as long as power is maintained. In the disclosed arrangement, the vents include fluid responsive valves which close when flood waters attempt to enter the vents thereby substantially restricting the flow of flood waters into the enclosure.

7 Claims, 6 Drawing Sheets

PUMPING SYSTEM

DESCRIPTION

1. Technical Field

The present invention relates generally to pumping apparatus and in particular to a partially buried pumping station for transferring sewage or other effluent from one location to another.

2. Background Art

Sewage pumping or lift stations are commonly used to pump sewage from one location to another. Two types of systems are commonly used. In one system, submersible pumps are employed and are directly submerged in a wet well which collects the effluent. The pump is energized to transfer effluent from the wet well to a processing station or to another collecting device.

In an alternate system, above ground pumps are used that sit atop the wet well. The pumps draw the effluent from the wet well and like the submersible pump application, transfer it to another location.

In the submersible pump system, the pumping station is somewhat immune to flooding. Since the pumps themselves are submerged, as long as electrical power continues to be maintained, the pumping station will function. In addition, since the pumps are submerged, pump operating noise is reduced.

In the case of the above-ground type installation, it has been found that the flooding of the station will generally cause failure in the pump or pumps and as a result even if power is maintained, the pumping station will be rendered inoperative. Moreover, after the flooding has receded, repairs must be made to the above-ground pump or pumps and related hardware to correct damage caused by the flood water. In the above-ground type station however, maintenance of the pumps can be easily effected during normal operation. The pumps are normally easily accessible and do not require specialized equipment to raise them from the wet well. However, since the pumps are located above ground, pump noise can be objectionable, especially in residential areas.

Submersible pumps, on the other hand, are very difficult to maintain. If a failure occurs in a pump, special equipment must be used to raise the pump from the wet well before it can be repaired. In addition, since the pump must be water-tight, repairs, maintenance and parts can be very expensive.

DISCLOSURE OF THE INVENTION

The present invention provides a new and improved pumping system which is somewhat immune to flooding but which retains the advantages of an above-ground pump system. The disclosed system utilizes above-ground, preferably self-priming centrifugal pumps which are easily serviced and which are readily accessible.

In the preferred and illustrated embodiment, the pump system comprises a partially buried enclosure which surrounds and protects the pumps and associated hardware. The enclosure also minimizes or controls the amount of machinery noise that is released to the environment. A wet well for collecting effluent to be transferred, is located below the pump enclosure. The pump enclosure itself, sets atop a wet well cap which covers the wet well. One or more above-ground pumps located within the enclosure are activated in order to draw the effluent from the wet well and pump it to a discharge or transfer conduit.

According to the invention, the enclosure is covered by a removable station lid which sealingly engages an enclosure wall. In the preferred and illustrated embodiment, the enclosure wall is cylindrical and the station lid is substantially round. Vents are formed in the enclosure to provide the necessary ventilation for the pumps during operation. The vents, however are arranged so that in the event the flooding, the flow rate of flood waters through the vents is restricted to an amount that can be easily handled by the pumps as long as power is available. As a result, the pumps themselves do not become submerged during flood conditions. In the illustrated embodiment, flood waters (or other fluid) entering the station enclosure drains through the lift station floor into the wet well by way of a drain and check valve. The check valve allows fluid to drain from the enclosure but prevents effluent in the wet well from entering the enclosure.

In order to maintain power during flooding, power connections as well as control circuitry are located outside of the pump enclosure preferably mounted to a pole or other device so that the critical electrical components are mounted well above normal flood levels. Only the required power cables are routed to and are located in the enclosure itself.

According to a feature of the invention, the station cover or lid is raisable and movable to a retracted position in order to provide full access to the inside of the pump station. In the preferred and illustrated embodiment, a raising mechanism preferably a jack arrangement located inside the station is operatively connected to the lid.

After the cover is raised by the jack arrangement, the cover is movable to a position at which it substantially uncovers and fully exposes the machinery housed within the station. In one preferred and illustrated embodiment, the cover is eccentrically mounted and rotatable on a vertically oriented spindle located near the perimeter of the enclosure wall. In accordance with this feature, the raising mechanism raises the cover a distance sufficient to clear the top edge of the housing. After being raised, the cover is then rotatable about the spindle to a remote position.

According to a feature of this embodiment, detents are provided to mechanically lock the rotated position of the cover so that uncontrolled movement in the cover is inhibited. In the preferred arrangement, one of the detents locks the cover in its overlying position at which it is aligned with the perimeter of the pump enclosure wall. After the cover is raised, the detent is released in order to allow the cover to rotate to the retracted position where it again is locked to prevent further rotation.

According to another preferred and illustrated embodiment, the station cover is supported on a trackway that forms part of the cover raising mechanism. In this embodiment, after the cover is raised, it is slid transversely along the trackway to a retracted position at which it exposes the interior of the station.

According to still another embodiment, the cover is supported by both a rotatable hub assembly and a trackway. In this embodiment, the cover can be moved to a retracted position by a combination of rotative and transverse rectilinear movements.

With the disclosed construction, access to the inside of the pump station is easily achieved. Moreover, the jack mechanism allows a single person to raise and rotate the cover to obtain access to the inside of the station. The problems associated with the lifting of a heavy cover as is the case with hinged arrangements, is obviated.

The disclosed raising mechanism has an additional advantage. In order to minimize the above ground protrusion of the station enclosure, it is desirable to minimize the height of the enclosure. As a result, the height of the enclosure is normally less than the average human height. With more conventional arrangements such as a hinged station cover, after the cover is removed or displaced the serviceman or operator can then service the equipment. During the servicing, the equipment as well as the serviceman are totally exposed to the elements. If the station cover is used as protection (by reclosing the station) the serviceman must work in extremely cramped conditions.

With the present invention this problem is alleviated. Should the serviceman need or desire protection or shelter from the outside elements, he or she can raise and retract the station cover in order to enter the enclosure. The cover is then moved to its overlying position but left in the raised position. In this position, the cover shelters the serviceman without compromising head room in the enclosure.

The vents in the pump station provide the necessary ventilation air for the machinery to prevent overheating, etc. Forced air ventilation may be provided by a suitable blower. In the preferred arrangement, the vents are configured such that during flood conditions the flow of flood waters through the vents into the pump station is controlled to an amount that can be handled by the pumps so long as power continues to be maintained. In one embodiment, the vents are sized to provide the necessary flow restriction. In another embodiment, one way valves are used which automatically close during flooding to prevent substantial flows of flood waters into the pump station.

Additional features of the invention will become apparent and a fuller understanding obtained by reading the following detailed description made in connection with the accompanying drawings.

BEST MODE FOR CARRYING OUT THE INVENTION

Figure 1:
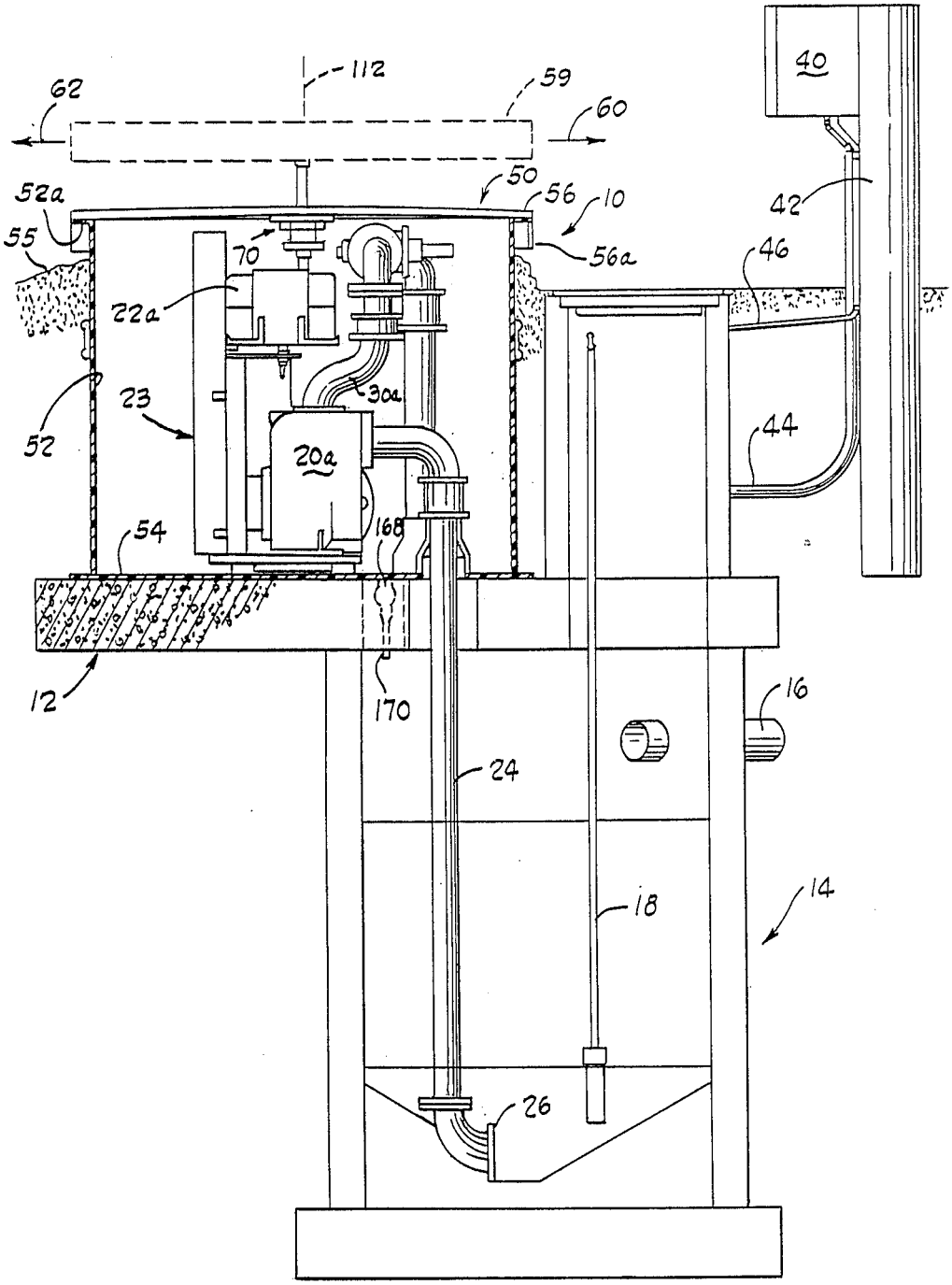
FIG. 1 is a side elevational view, partially in section, of a lift station constructed in accordance with the preferred embodiment of the invention.

FIG. 1 illustrates the overall construction of a pumping or lift station constructed in accordance with the preferred embodiment of the invention. The station comprises a partially buried pumping unit 10 that sets atop a concrete well cap 12. The well cap 12 covers a conventional wet well 14. Sewage enters the wet well 14 through an inlet pipe 16. A depth sensor or "bubbler" line 18 extends into the wet well. Effluent is drawn from the wet well 14 by one or more pumps **20*a*, 20*b* (See FIGS. 2 and 3). The pump 20*a* is of the self-priming centrifugal variety and is driven by a drive motor 22*a* through a belt drive, indicated generally by the reference character 23. Effluent is drawn from the wet well 14 through a suction pipe 24 that terminates at one end in a right angle elbow 26**.

Figure 2:
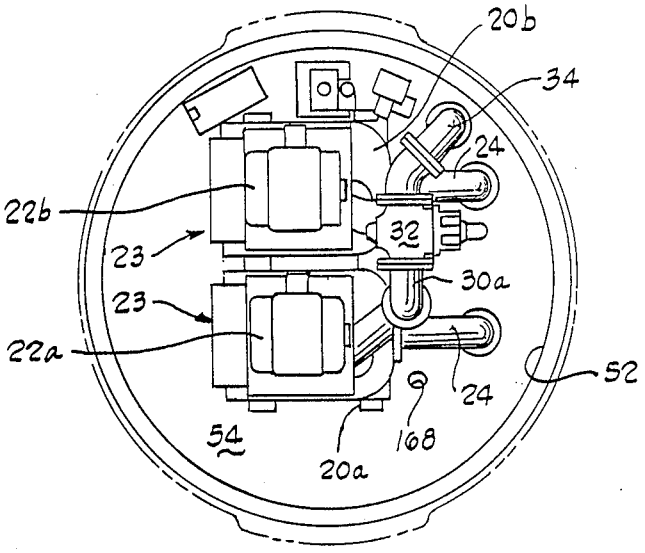
FIG. 2 is a top plan view with a cover removed, showing the interior of the pumping station.
Figure 3:
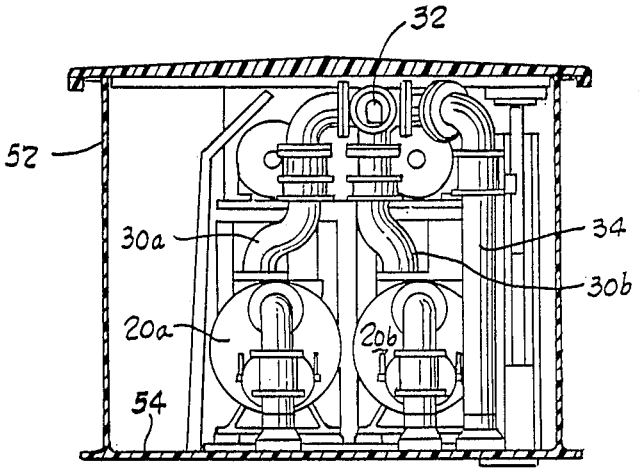
FIG. 3 is a fragmentary, side elevational view, partially in section, of a pumping unit.

Referring also to FIG. 2, the effluent is transferred under pressure by the pump **20*a* to a discharge conduit 30*a*. As seen in FIGS. 2 and 3, a similar discharge conduit 30*b* extends from the pump unit 20*b* and joins a fitting 32. An outlet pipe 34 extends from the fitting 32. In the illustrated embodiment, the outlet pipe 34 extends downwardly and re-enters the wet well 14** and then continues onto a remote location. It does not open into the wet well however.

As seen in FIG. 1, a control panel 40 mounted to a utility pole 42 houses control circuitry for the pump motors **22*a*, 22*b*. Power for the pumps and for a ventilation blower 43 (shown in FIG. 5) are carried to the pumping unit 10 by a conduit 44. A signal line for the bubbler 18 also extends into the control panel 40 by way of a connecting line 46**. In the preferred arrangement, all critical control circuitry is mounted remotely from the pumping unit at a height above the normal flood level. In this way, power can be maintained to the pumps even during flood conditions.

In accordance with the invention, the pumping unit 10 includes an enclosure indicated generally by the reference character 50. The enclosure includes a cylindrical, intermediate wall section 52 that sets atop and is fixed to a circular base section 54. The upper end of the cylindrical section 52 terminates in a radially extending lip **52*a*. A movable station cover 56 including a downwardly extending flange 56*a* sits atop the cylindrical wall section 52 and surrounds the lip 52*a* when the enclosure 50 is closed. A suitable seal or gasket 57 (shown in FIG. 8) inhibits leakage between the cover 56 and the cylindrical section 52 when the cover is closed. The enclosure 50 is preferably made from a corrosion resistant material such as fiberglass and is at least partially buried below a ground level 55**.

Access to the inside of the enclosure 50 is provided by first raising the cover 56, (as indicated in phantom in FIG. 1), to a position 59 where the lower edge of the cover flange **56*a* clears the lip 52*a*. After being raised, the cover is then rotated or slid in either of the directions indicated by the arrows 60, 62 in FIG. 1**.

Figure 4:
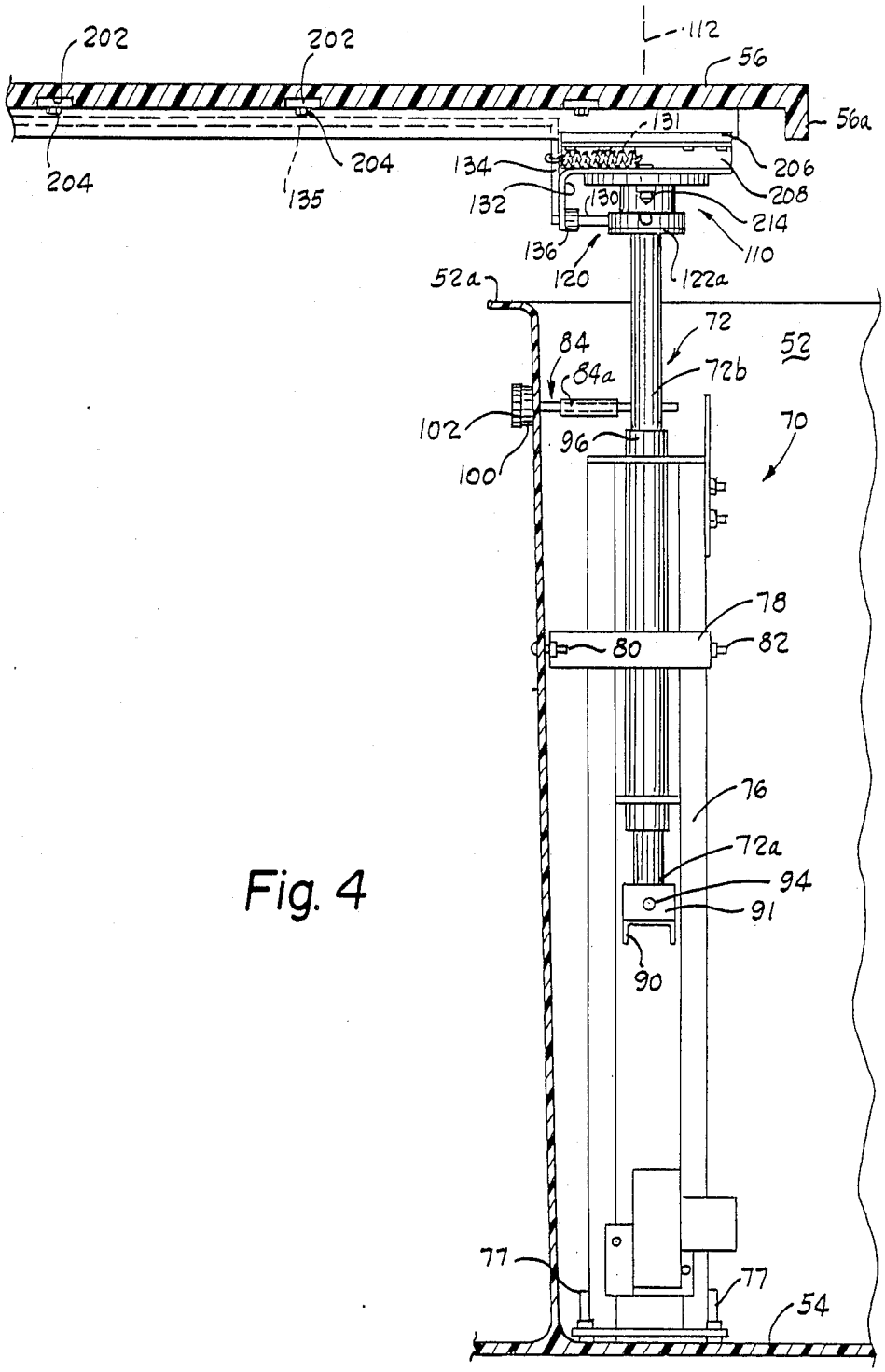
FIG. 4 is a fragmentary side view of a jack arrangment for lifting the station cover, constructed in accordance with the preferred embodiment of the invention.
Figure 5:
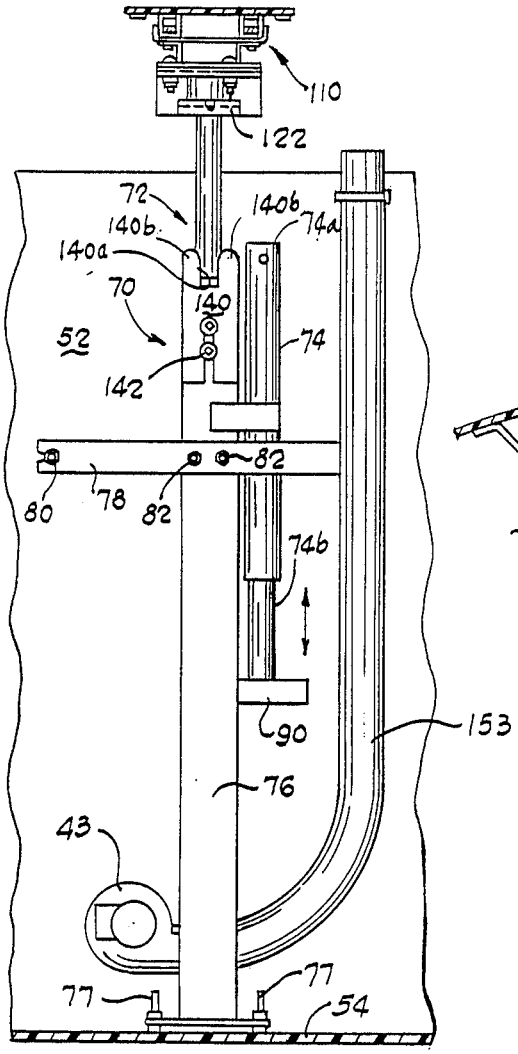
FIG. 5 is another side elevational view of the jack arrangement as seen from a plane rotated 90° from the view shown in FIG. 4.
Figure 6:
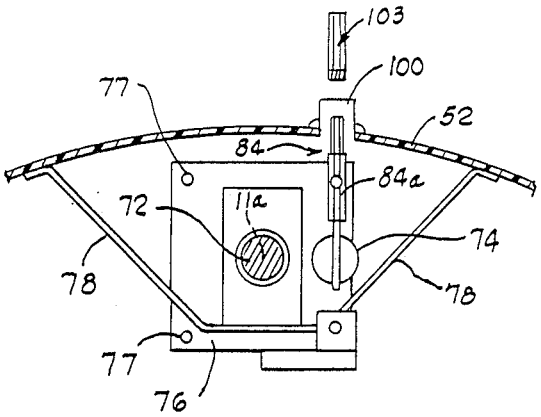
FIG. 6 is a fragmentary top view of the jack arrangement shown in FIG. 4.

The cover 56 is raised and lowered by a jack mechanism indicated generally by the reference character 70 in FIG. 1. Referring also to FIGS. 4–6, the station cover raising mechanism 70 comprises a vertically movable spindle assembly indicated generally by the reference character 72. The spindle assembly 72 is raised and lowered by a jack 74 which is mounted immediately adjacent the spindle 72. The spindle assembly and jack are supported in a jack support stand 76 which is fixed to the base of the enclosure 50 by a plurality of fasteners 77. The position of the jack support and its mounting are further buttressed by a strap 78 which is bolted to the side of the cylindrical wall section 52 and to the jack support stand 76 by fasteners 80, 82 respectively. The jack 74 is of conventional construction and includes a fixed section 74*a* and a telescopic section 74*b* which slides within the fixed section 74*a*. As is conventional, a crank pin 84 (shown in FIG. 4) is rotated to produce rotation in a threaded internal shaft (not shown) which produces axial motion in the movable section 74*b*. As seen in FIG. 5, rotation of the crank pin 84 produces vertical motion either in the upward or downward direction, depending on the direction of rotation of the crank pin 84. The motion of the movable section 74*b* is indicated by the double arrow 86 in FIG. 5.

A U-shaped channel 90 extends transversely from the bottom of the movable segment 74*b* and connects to a base end 72*a* of the spindle 72. In the preferred embodiment, a socket like fitting 91 is fixed to the channel 90 and receives the lower end 72*a* of the spindle. A transversely extending pin 94 extends through the socket 91 and through an aligned bore (not shown) formed at the base of the spindle 72*a* and locks the spindle to the socket 91 and hence the channel 90. The spindle includes a uniform diameter section 72*b* which is slidably supported in a bearing housing 96. When the jack 74 is actuated to lower or raise the movable section 74*b*, the motion in the movable section is transferred to the spindle 72 via the channel 90 and hence, the spindle 72 is raised and lowered in accordance with movement in the jack 74.

In the preferred embodiment, the crank pin 84 includes one end fixed in operative engagement with the jack 74. The other end extends into an access port 100 which is closed by a removable cap 102. Referring in particular to FIG. 6, when the cover 56 is to be raised, the cap 102 is removed and a suitable tool such as a socket 103 is inserted through the port 100 and engages a hexagonal segment 84*a* formed on the crank pin 84 and the socket is then rotated with a suitable implement by the operator to rotate the crank pin 84 and raise the lid 56.

Referring to FIGS. 4 and 5, in one preferred embodiment, the spindle 72 mounts a hub assembly 110 at its upper end. The hub assembly 110 allows the cover 56 to be rotated about a vertical axis 112 once it is raised and clears the lip 52*a* of the wall section 52. The pivot hub assembly 110 preferably includes bearings (not shown) to facilitate and support rotation of the cover 56.

Figure 7:
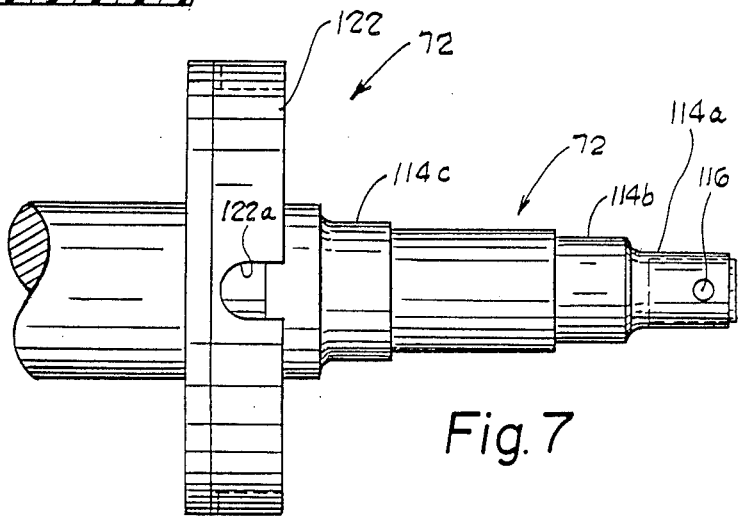
FIG. 7 is a side elevational view of a spindle forming part of the jack arrangement.

Referring to FIG. 7, one method for rotatably mounting the hub assembly 110 is illustrated. In this embodiment, the hub assembly is mounted essentially similar to the method by which wheel hubs are mounted on automobiles. In particular, the spindle 72 includes an upper machine end 72*b*. The machine end includes a narrow diameter portion 114*a* that includes a transverse cotter pin bore 116. The narrow diameter segment 114*a* is threaded and is adapted to receive a conventional castle nut by which the hub assembly 110 is secured to the upper end of the spindle 72. The machine end also includes machined bearing seats 114*b* and 114*c*. As is conventional, the bearing seats are sized to receive tapered roller bearing assemblies (not shown). The assemblies normally comprise a pair of inner and outer bearing races between which are captured a plurality of tapered rollers. The pair of roller bearings rotatably support the hub assembly 110 on the upper end 72*b* of the spindle 72. A cotter pin (not shown) secured in the bore 116 prevents the castle nut (not shown) from being released.

To prevent uncontrolled rotation of the cover 56, a lock arrangement indicated generally by the reference character 120 in FIG. 4 is provided. In the disclosed embodiment, upper end 72*b* of the the spindle 72 mounts a lock ring 122 which is fixed against rotation. The ring 122 defines a plurality of notches 122*a* which in the preferred embodiment are spaced approximately 90° apart.

A pin 130 is carried by the hub assembly 110 and is engageable with the slots 122*a*. The pin 130 is spring biased towards engagement with the lock-ring 122 by a conventional tension spring 131 shown only in FIG. 4. A right angle bracket 132 extends from the hub assembly 110 and slidable supports the pin 130. A vertical link 134 extends upwardly from the pin 130 and is connected to an actuating rod 135 which is accessible once the cover 56 is raised. In normal operation, the cover is locked in a rotative position until the actuating rod 135 is pulled in order to move the pin 130 leftwardly (as viewed in FIG. 4) in order to disengage a slot 122*a*. When the rod 134 is pulled, the cover can then be rotated about the axis 112 to any desired position. Releasing the rod 134 will then allow the pin 130 to re-engage one of the slots 122*a* to again lock the cover in position. With the disclosed arrangement, sudden or unexpected movement in the cover is inhibited. In order to rotate the cover, the lock assembly must first be released by the operator.

The cover raising mechanism also includes provision for insuring alignment of the cover 56 with the wall section 52 when the cover is lowered to its closed position. Referring to FIGS. 4 and 5, the bracket 132 which supports the locking pin 130 also includes a guide collar 136 fixed to the bracket 132. The guide collar 136 includes a bore (not shown) which slidably supports the pin 130. The exterior of the collar, however, is configured to coact with a guide plate 140 (shown in FIG. 5). The guide plate 140 includes a vertical slot 140*a* defined between two upwardly extending legs 140*b* which terminate in arcuate surfaces. The guide plate 140 is fixed to the jack support stand 76 by a plurality of bolts 142. As the cover 56 is lowered into its closed position, the guide collar engages the vertical slot 140*a* and locks the cover 56 in its overlying, aligned position.

Figure 8:
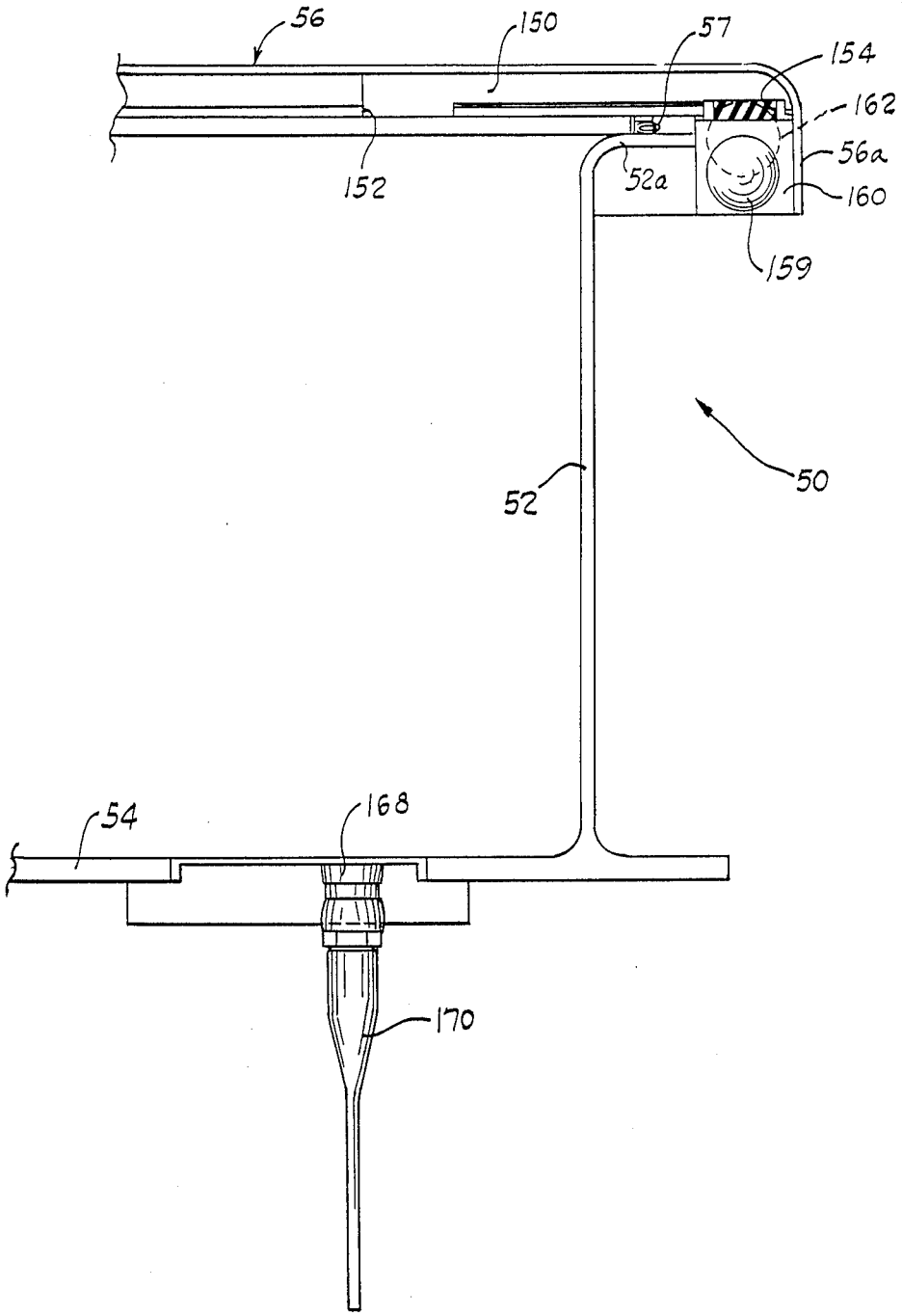
FIG. 8 is a fragmentary, sectional view of a pump enclosure constructed in accordance with one embodiment of the invention.

According to a feature of the invention, the inflow of fluid into the pump station during flood conditions is controlled. As indicated above, ventilation is provided in order to cool the machinery housed within the station housing 50. Turning now to FIG. 8, one embodiment of the venting is illustrated. In this embodiment, the cover includes a vent passage 150 which allows ventilation air from the atmosphere to enter the station housing 50 through an outlet port 152. The outlet port may be connected to the forced air blower 43 (shown in FIG. 5) by a suitable conduit 153 (also shown in FIG. 5). The air enters the passage 150 through an inlet opening 154 which communicates with the atmosphere. As can been seen in this figure, the cover 56 sealingly engages the radial lip 52*a* by means of the seal 57. In one embodiment, the inlet 154 is sized so that the inflow of flood waters into the station is limited to an amount that can be pumped out of the station by the pumps 20*a*, 20*b* as long as power remains connected. In the alternate embodiment, shown in FIG. 8, a ball valve is utilizied to control the flow of flood waters into the inlet 154. In this embodiment, the ball valve includes a buoyant, spherical element 159 captured within a housing 160. When fluid attempts to enter the vent from outside the housing 50, the ball 159 rises to its phantom position indicated by the reference character 162 and seals off the inlet 154 substantially inhibiting the flow of flood waters into the station. The leakage of water normally expected to occur into the housing during flooding, can be easily controlled by the pumps.

The flood waters that do enter the housing 50, drain into the wet well 14 (shown in FIG. 1) through a drain 168 and check valve 170. As long as the wet well 14 does not completely fill with effluent which is normally the case as long as the pumps 20*a*, 20*b* remain operational, waters entering the station housing 50 will simply exit the station through the check valve 170 and then be pumped from the wet well 14 along with the effluent. In this way, the disclosed pump station remains substantially immune to flooding as long as power remains connected to the pumps.

The disclosed jack mechanism is but one of a plurality of raising mechanisms contemplated by the present invention. The manually operated jack 74 in the illustrated embodiment is of conventional construction and a jack of this type is available from the Hammerblow Corporation of Wausau, Wis. Other jacks may be employed. In fact, a motorized or power jack arrangement is also contemplated. For example, a suitable drive motor and belt or chain arrangement can be attached to the crank pin 84 to enable the cover to be power driven to its raised position. In addition, hydraulically operated and cable/winch arrangements are also contemplated by the present invention.

Figure 9:
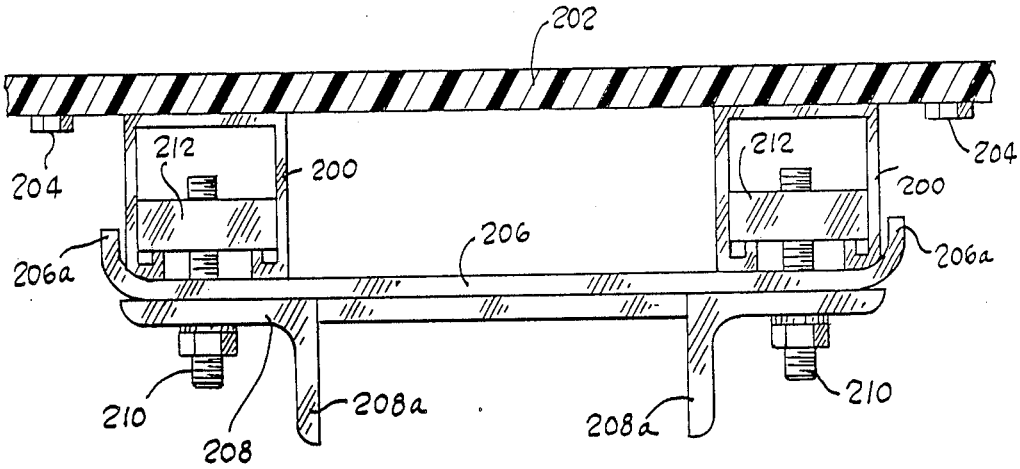
FIG. 9 is an enlarged elevational view of one embodiment of a support for a pump station cover; and, FIG. 10 is an enlarged, elevational view of another embodiment of a support for the pump station cover.

Turning now to FIGS. 4, 5, 9 and 10, two methods for mounting the station cover 56 are illustrated. In the method shown in FIGS. 4, 5 and 9, the cover is substantially fixed to the spindle assembly. Relative movement between the spindle and cover 56 is inhibited. Referring in particular to FIG. 9, a pair of U-shaped channels 200 extend below the cover 56. A plurality of cross pieces 202 are fixed, as by welding, across the channels 200 at spaced positions. The cross pieces 202 are in turn bolted to the underside of the cover by a plurality of fasteners 204.

Although a variety of U-channels 200 can be used, in the illustrated embodiment channels sold under the trademark UNISTRUT which are available from Unistrut, Division of GTE Products Corporation, are used. The channels 200 are bolted to the relatively short mounting plate 206 having up turned ends 206*a*. The support plate 206 is in turn locked to a mounting plate 208 including a pair of depending legs 208*a*. As seen best in FIG. 9, bolts or studs 210 extend through the mounting and support plates 206, 208 and receive nuts 212 which engage individual legs 200*a* of the channels 200 and secure the channels 200 to the support plate 206. In the preferred and illustrated embodiment, the mounting member 208 is suitably secured to the hub assembly 110 by bolts 214 (shown in FIG. 4 only).

Figure 10:
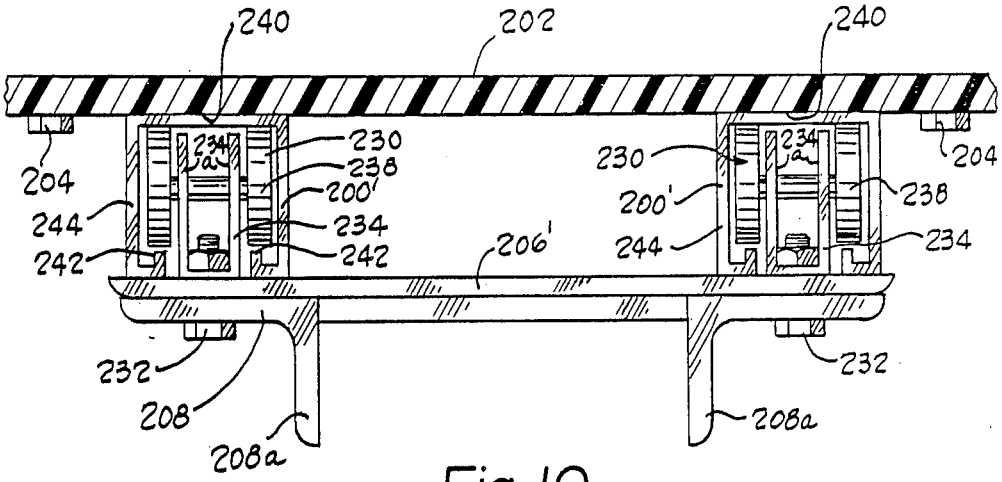

FIG. 10 illustrates an alternate embodiment of the mounting arrangement in which a trackway is provided to allow the cover 56 to move in a rectilinear path. In this embodiment, similar U-channels 200' are used which are also available from Unistrut, a Division of GTE Products Corporation. Cross pieces 202 are fixed to the channels 200' at spaced locations as in the embodiment shown in FIG. 9. However in this embodiment, trolley assemblies (also available from Unistrut) 230 are bolted to a support plate 206' by bolts 232 (and the mounting member 208). The trolley assemblies 230 include an up standing U-shaped channel 234 having a pair of legs 234*a*. A plurality of rollers 238 arranged in pairs, are rotatably mounted by the channel 234. The rollers ride against either a web section 240 of the channels 200' or edge surfaces 242 formed on J-shaped legs 244 of each channel 200', depending on the loading. In the arrangement illustrated in FIG. 10, after the cover 56 is raised, it can be slid along the trackway defined by the channels 200' and the trolleys 230, to a retracted position. Depending on the desired range of movement, the mounting assembly shown in FIG. 10 can be either rigidly fixed to the top end of the spindle 72 so that only rectilinear movement is allowed once the cover is raised. Alternately, the arrangement can be mounted to the hub assembly 110 so that combinations of rectilinear and rotative movement can be used to move the station cover 56 to its retracted position. When both the trackways and hub assembly 110 are used, the additional flexibility allows the cover 56 to be moved to a plurality of retracted positions.

As should be apparent, the present invention provides a pump station utilizing above-ground pumps that are readily accessible for maintenance and service while still providing substantial immunity from flooding. The advantages normally associated with pump stations using submersible pumps, i.e., reduced noise and flood immunity are achieved in an above-ground installation without the attendant cost associated with submersible pump installations.

Although the invention has been described with a certain degree of particularity it should be understood that those skilled in the art can make various changes to it without departing from the spirit or scope of the invention as hereinafter claimed.

We claim:

1. A pumping station, comprising:

(a) a below ground wet well for receiving effluent;

(b) a wet well cap sitting atop and covering said wet well;

(c) a pumping unit located above said wet well cap, comprising:

(i) an enclosure surrounding a pump means, said means operative to draw effluent from said wet well and transfer it to a discharge conduit;

(ii) said enclosure defined by a wall section including a substantially vertical portion and a removable cover sealingly engageable with said wall section;

(d) a cover raising means including a jack mechanism for raising said cover to a position above said wall section at which said cover clears a top end surface of said wall section;

(e) said jack mechanism including a hub assembly rotatably supporting said cover for rotation about a substantially vertical axis and operative to allow said cover to rotate to a transverse position at which said pumping means is substantially exposed;

(f) vent means for providing ventilation air into said enclosure when said pumping means is operating, said vent means configured such that during flooding conditions, the inflow of flood waters into said is restricted to an amount that can be pumped from said enclosure by said pumping means; and, (g) means communicating liquid entering said enclosure with said wet well but inhibiting liquid flow fron said wet well into said enclosure.

2. The apparatus of claim 1 wherein said hub assembly includes locking means for inhibiting uncontrolled rotative movement in said cover after it has been raised by said jack means.

3. The apparatus of claim 1 further comprising control means for said pump means, said control means located remote from said enclosure and at a level above the normal flood level for a region in which said pumping station is located.

4. The apparatus of claim 1 wherein said vent means includes fluid responsive valve means which closes to inhibit the flow of flood waters into said vents.

5. The apparatus of claim 4 wherein said means comprise a buoyant spherical valve element which sealingly engages a valve seat when liquid attempts to enter said vent means from outside said enclosure.

6. The apparatus of claim 1 wherein said enclosure includes a drain for draining fluid entering said enclosure into said wet well whereby said fluid in pumped from said wet well by said pumping means.

7. A lift station, comprising:

(a) a corrosion resistant enclosure at least partially buried below a ground level;

(b) said enclosure housing a pumping means for pumping effluent from an effluent reservoir;

(c) a station lid forming part of said enclosure and sealingly engageable with a wall segment;

(d) cover raising means including means for raising said station cover substantially vertically to substantially disengage said wall segment;

(e) support means, supporting said cover for transverse movement with respect to said wall segment such that said station cover can be moved to a retracted position at which an inside region of said enclosure is substantially exposed; and (f) movement control means forming part of said raising mechanism for preventing uncontrolled movement in said station cover, said movement control means comprising a detent engageable with a detent means for securing said cover in a predetermined position until said detent is released; and, (g) vent means for providing ventilation air into said enclosure.

* * * * *

UNITED STATES PATENT AND TRADEMARK OFFICE

CERTIFICATE OF CORRECTION

PATENT NO. : 4,758,133

DATED : July 19, 1988

INVENTOR(S) : Burns W. Clark and Paul F. Brown

It is certified that error appears in the above-identified patent and that said Letters Patent is hereby corrected as shown below:

Column 8, line 67, before "is" insert --enclosure--;

Column 9, line 23 "in" should be --is--.

Signed and Sealed this

Twentieth Day of December, 1988

*Attest:*

DONALD J. QUIGG

*Attesting Officer*

*Commissioner of Patents and Trademarks*